US012392347B1

(12) United States Patent
Zhang et al.

(10) Patent No.: US 12,392,347 B1
(45) Date of Patent: Aug. 19, 2025

(54) CENTRIFUGAL COMPRESSOR IMPELLER AND METHOD OF PRODUCING THE SAME

(71) Applicant: Pratt & Whitney Canada Corp., Longueuil (CA)

(72) Inventors: Chao Zhang, Vaughan (CA); Rambod Larijani, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 18/443,905

(22) Filed: Feb. 16, 2024

(51) Int. Cl.
*F04D 17/10* (2006.01)
*F04D 29/28* (2006.01)

(52) U.S. Cl.
CPC ..... *F04D 17/10* (2013.01); *F04D 29/284* (2013.01)

(58) Field of Classification Search
CPC ..... F04D 17/10; F04D 29/26; F04D 29/28; F04D 29/284
See application file for complete search history.

(56) References Cited

U.S. PATENT DOCUMENTS

| | | | |
|---|---|---|---|
| 8,641,380 | B2 | 2/2014 | Mckenzie |
| 9,500,084 | B2 | 11/2016 | Raman |
| 9,624,776 | B2 | 4/2017 | Chandramohanan |
| 9,951,627 | B2 | 4/2018 | Yagi |
| 9,970,452 | B2 | 5/2018 | Conner |
| 10,385,864 | B2 | 8/2019 | Pham |
| 10,781,823 | B2 | 9/2020 | Yoshizaki |
| 10,883,513 | B2 | 1/2021 | Fujita |
| 11,473,588 | B2 | 10/2022 | Mavrosakis |
| 11,493,054 | B2 | 11/2022 | Yagi |
| 11,795,821 | B1 | 10/2023 | Mangardich |

(Continued)

FOREIGN PATENT DOCUMENTS

| | | | |
|---|---|---|---|
| CN | 104775856 | A | 7/2015 |
| JP | 2001304182 | A | 10/2001 |
| JP | 2011085088 | A | 4/2011 |

OTHER PUBLICATIONS

Alcea et al. "Mechanical Stress Design of a Highly Loaded Radial Inflow Turbine for Compact CHP Turbine", 2019 International Conference on Energy and Environment, Oct. 17, 2019, pp. 224-228.

(Continued)

*Primary Examiner* — Elton K Wong
(74) *Attorney, Agent, or Firm* — Getz Balich LLC

(57) ABSTRACT

A method of producing a centrifugal compressor impeller is provided. The impeller includes a hub with a rotational axis, and forward and aft surfaces. The aft surface extends between an outer radial surface of the impeller and a bore centered on the rotational axis. The method includes: analyzing the impeller to determine a stress field having tangential stress data values and radial stress data values as a function of radial position within the impeller hub and as a function of axial position within the impeller hub; determining biaxiality ratio (BR) data using the determined tangential stress data values and the determined radial stress data values; determining a peak von Mises creep strain location on the impeller; contouring the aft surface at the peak von Mises creep strain location using the radial stress data values and the BR data; and producing the impeller with the contoured aft surface.

8 Claims, 7 Drawing Sheets

(56) References Cited

U.S. PATENT DOCUMENTS

| | | | | |
|---|---|---|---|---|
| 2012/0152007 | A1* | 6/2012 | Holmes | G06F 30/23 73/112.01 |
| 2017/0037864 | A1* | 2/2017 | Pham | F01D 5/043 |
| 2021/0140443 | A1 | 5/2021 | Yamagata | |

OTHER PUBLICATIONS

Ferdinand, "Development of a Mixed-Flow Compressor Impeller for Micro Gas Turbine Application", Thesis, Mar. 1, 2016, pp. i-xvii, https://cfturbo.com/fileadmin/content/down/publications/students/2016-03-Diener-Mixed-Flow-Compressor.pdf.
EP search report for EP25158083.3 dated Jul. 1, 2025.

* cited by examiner

CENTRIFUGAL COMPRESSOR IMPELLER AND METHOD OF PRODUCING THE SAME

BACKGROUND OF THE INVENTION

1. Technical Field

The present disclosure relates to gas turbine engines in general, and to gas turbine engines that include a centrifugal compressor in particular.

2. Background Information

A gas turbine engine includes in serial flow communication a compressor section for pressurizing air, a combustor in which the compressed air is mixed with fuel and ignited for generating an annular stream of hot combustion gases, and a turbine section for extracting energy from the combustion gases. A fan section may be disposed forward of the compressor section. Some gas turbine engines utilize one or more centrifugal compressor stages that are driven at considerable rotational speed; e.g., up to about 45,000 revolutions per minute (RPM). During operation, the impeller of the centrifugal compressor will primarily experience tangential stress ($S_T$) and radial stress ($S_R$). Tangential stress (sometimes referred to as "hoop stress") acts in a direction that is perpendicular to both the radius of the impeller and the rotational axis of the impeller. Radial stress acts in a direction that is coplanar with the radius and is perpendicular to the rotational axis of the impeller. Tangential stress and radial stress are functions of the angular velocity of the impeller and both vary as a function of radial distance from the rotational axis of the impeller. There is always a need to improve the durability of engine components, including the impeller of a centrifugal compressor.

SUMMARY

According to an aspect of the present disclosure, a method of producing a centrifugal compressor impeller is provided. The impeller includes a hub with a rotational axis, a forward surface, and an aft surface. The aft surface extends between an outer radial surface of the impeller and a bore centered on the rotational axis. The method includes: analyzing the impeller to determine a stress field having tangential stress data values and radial stress data values as a function of radial position within the impeller hub and as a function of axial position within the impeller hub; determining biaxiality ratio (BR) data using the determined tangential stress data values and the determined radial stress data values; determining a peak von Mises creep strain location on the impeller; contouring the aft surface at the peak von Mises creep strain location using the radial stress data values and the BR data; and producing the impeller with the contoured aft surface.

In any of the aspects or embodiments described above and herein, a portion of the aft surface may have a concave arcuate contour that defines a rear cavity.

In any of the aspects or embodiments described above and herein, the step of contouring the aft surface step may include contouring at least a portion of the rear cavity.

In any of the aspects or embodiments described above and herein, the step of contouring the aft surface may include providing a hub thickness aligned with the peak von Mises creep strain location so that the impeller hub has a localized area of decreased radial stress data values at the peak von Mises creep strain location.

In any of the aspects or embodiments described above and herein, the step of contouring the aft surface may include providing a hub thickness aligned with the peak von Mises creep strain location so that the impeller hub has a localized area of decreased BR data values at the peak von Mises creep strain location.

In any of the aspects or embodiments described above and herein, the step of contouring the aft surface may include providing a hub thickness aligned with the peak creep strain location so that the impeller hub has a localized area of decreased von Mises stress ($S_{VM}$) values at the peak von Mises creep strain location.

In any of the aspects or embodiments described above and herein, the step of contouring the aft surface may include providing a hub thickness aligned with the peak von Mises creep strain location so that the impeller hub has a localized area of decreased BR data values at the peak von Mises creep strain location.

In any of the aspects or embodiments described above and herein, the step of contouring the aft surface includes providing a hub thickness aligned with the peak creep strain location so that the impeller hub has a localized area of decreased von Mises stress ($S_{VM}$) values at the peak von Mises creep strain location.

In any of the aspects or embodiments described above and herein, the step of contouring the aft surface may include providing a hub thickness that has a first region of radial stress data values, a second region of radial stress data values, and a third region of radial stress data values, wherein the first region of radial stress data values is disposed at a first radius from the rotational axis, the second region of radial stress data values is disposed at a second radius from the rotational axis, and the third region of radial stress data values is disposed at a third radius from the rotational axis, wherein the second radius is greater than the first radius, and the third radius is greater than the second radius, and wherein the radial stress data values in the second region are lower than the radial stress data values in both the first region and the third region, and wherein the determined von Mises peak creep strain is disposed at the second radius.

According to an aspect of the present disclosure, a centrifugal compressor impeller is provided that includes a hub, a forward surface, and an aft surface. The hub has a bore centered on a rotational axis. The aft surface extends between an outer radial surface of the impeller and the bore of the hub. The impeller is configured so that the impeller hub has a localized region of decreased radial stress data values at a determined von Mises peak creep strain location relative to an inner radial region of radial stress data values that is contiguous with the localized region and relative to an outer radial region of radial stress data values that is contiguous with the localized region.

In any of the aspects or embodiments described above and herein, the impeller hub has a localized area of decreased biaxiality ratio (BR) data values at the determined peak von Mises creep strain location.

In any of the aspects or embodiments described above and herein, the impeller hub has a localized area of decreased von Mises stress ($S_{VM}$) values at the determined peak von Mises creep strain location.

According to an aspect of the present disclosure, a centrifugal compressor impeller is provided that includes a hub, a forward surface, and an aft surface. The hub has a bore centered on a rotational axis. The aft surface extends between an outer radial surface of the impeller and the bore of the hub. The impeller is configured so that the impeller hub has a first region of radial stress data values, a second region of radial stress data values, and a third region of radial stress data values. The first region of radial stress data values is disposed at a first radius from the rotational axis, the second region of radial stress data values is disposed at a second radius from the rotational axis, and the third region of radial stress data values is disposed at a third radius from the rotational axis. The second radius is greater than the first radius, and the third radius is greater than the second radius. The radial stress data values in the second region are lower than the radial stress data values in both the first region and the third region. A determined von Mises peak creep strain is disposed at the second radius.

In any of the aspects or embodiments described above and herein, the first region may be contiguous with the second region and the third region may be contiguous with the second region.

In any of the aspects or embodiments described above and herein, the impeller hub may have a localized area of decreased biaxiality ratio (BR) data values at the second radius, and may have a localized area of decreased von Mises stress ($S_{VM}$) values at the second radius.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. It should be understood, however, the following description and drawings are intended to be exemplary in nature and non-limiting.

DETAILED DESCRIPTION

Figure 1:
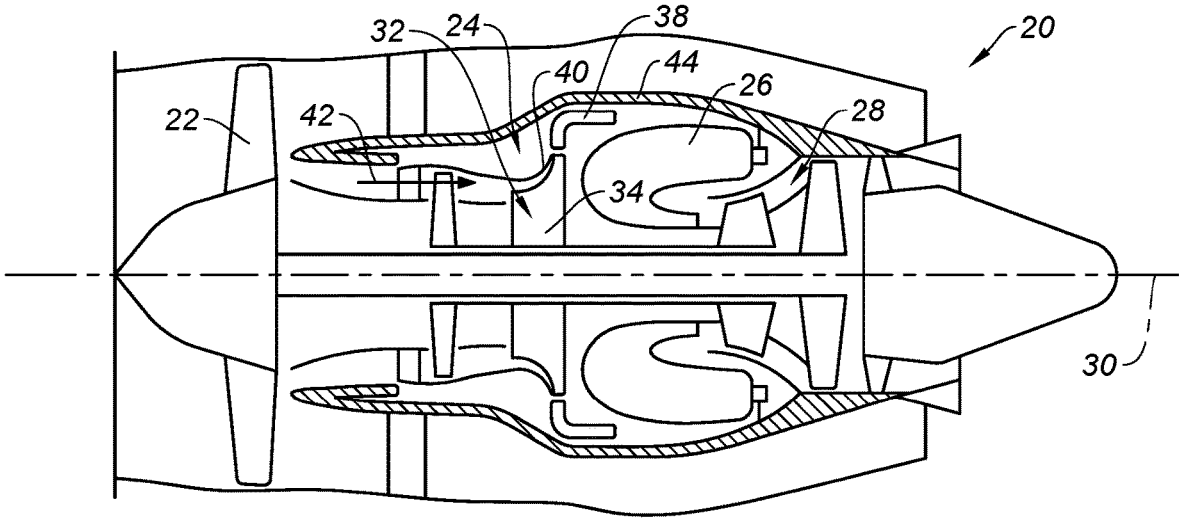
FIG. 1 is a diagrammatic representation of a gas turbine engine with which the present disclosure system may be utilized.

FIG. 1 illustrates a gas turbine engine 20 that includes in serial flow communication a fan section 22, a compressor section 24, a combustion section 26, and a turbine section 28. FIG. 1 also illustrates an axial centerline 30 of the gas turbine engine 20. Although depicted as a turbofan gas turbine engine in the disclosed non-limiting embodiments, it should be understood that the concepts described herein are not limited to use with turbofans as the teachings may be applied to other types of gas turbine engines including those with single-spool or three-spool architectures.

Figure 2:
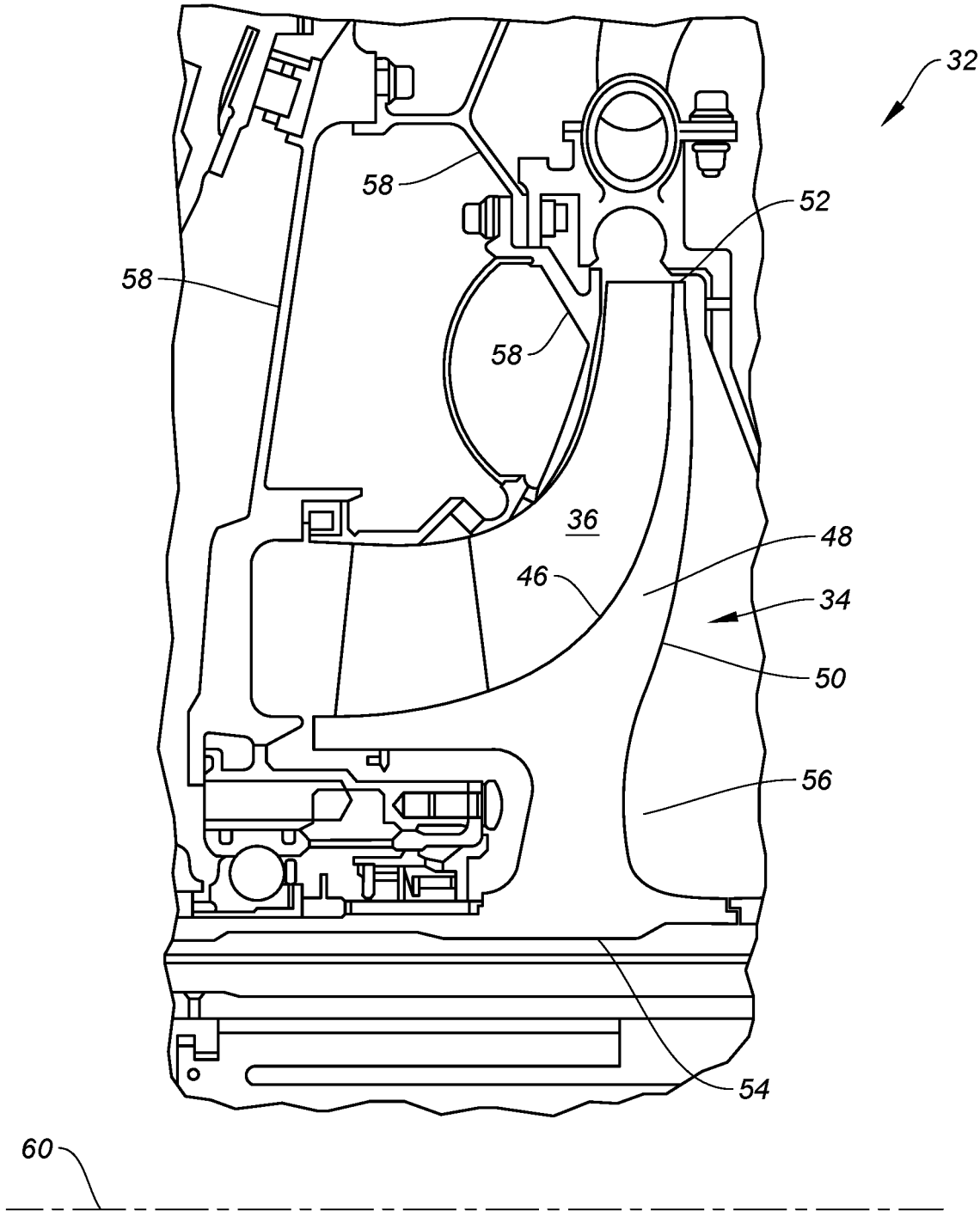
FIG. 2 is a diagrammatic cross-sectional partial view of a gas turbine engine equipped with a centrifugal compressor having an impeller.
Figure 3:
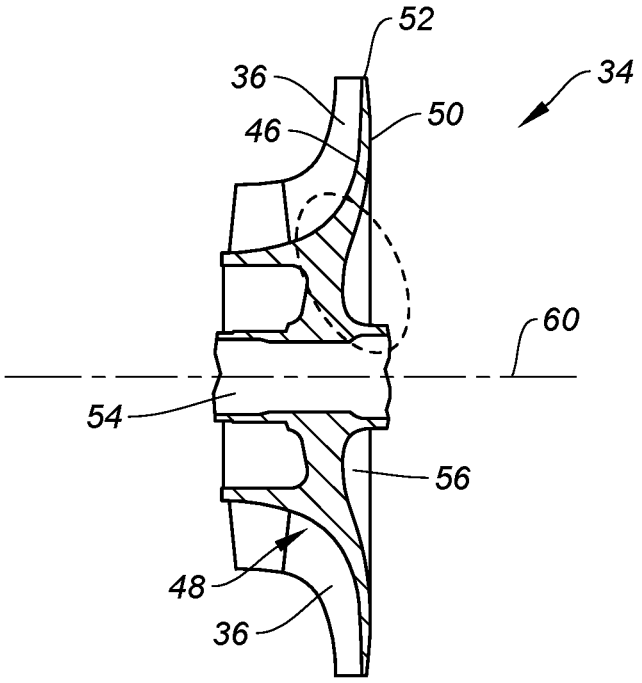
FIG. 3 is a diagrammatic sectioned view of a centrifugal compressor impeller embodiment.

The compressor section 24 of the gas turbine engine 20 includes one or more compressor stages, at least one of which includes a centrifugal compressor 32. Referring to FIGS. 2 and 3, the centrifugal compressor 32 includes a rotatable impeller 34 having a plurality of impeller blades 36 (shown in FIG. 2) and a downstream diffuser assembly 38. The impeller 34 is configured to rotate within an annular impeller shroud 40 disposed about the axial centerline 30. The impeller 34 draws air axially, and rotation of the impeller 34 increases the velocity of a core gas flow 42 through the compressor 32 as the core gas flow 42 is directed though the rotating impeller blades 36, to flow in a radially outward direction under centrifugal forces into the diffuser assembly 38. The compressor 32 is at least partially housed within an engine casing 44 which surrounds and structurally supports the compressor 32, the impeller shroud 40, and the diffuser assembly 38.

FIG. 2 illustrates a cross-sectional partial view of a gas turbine engine 20 equipped with a centrifugal compressor 32 having an impeller 34. FIG. 3 diagrammatically illustrates a sectional view of a centrifugal compressor impeller 34. The impeller 34 includes a plurality of impeller blades 36 extending out from a forward surface 46 of the impeller hub 48. The impeller blades 36 are disposed around the circumference of the impeller 34. The impeller hub 48 includes an aft surface 50 that extends from an outer radial surface 52 to a center bore 54 of the hub 48. The aft surface 50 is arcuately shaped and defines a rear cavity 56. The rear cavity 56 may be described as having a concave arcuate contour. FIG. 2 also illustrates static structures disposed 58 proximate the centrifugal compressor 32. The centrifugal compressor impeller 34 examples shown in FIGS. 2 and 3 are provided to facilitate the description herein. The present disclosure is not limited to these centrifugal compressor impeller 34 configurations.

Centrifugal compressor impellers are driven within a range of rotational speeds (angular velocities). The high end of that range may be a considerable rotational speed; e.g., up to or above 45,000 revolutions per minute (RPM). The core gas being worked by the impeller 34 produces some amount of load on the impeller 34 and consequent stress, but the most substantial stress is associated with the angular velocity of the impeller 34. During operation, the impeller 34 will primarily experience tangential stress ($S_T$) and radial stress ($S_R$). Tangential stress (sometimes referred to as "hoop stress") acts in a direction that is perpendicular to both the radius of the impeller 34 and the rotational axis of the impeller 34. Radial stress acts in a direction that is coplanar with the radius and is perpendicular to the rotational axis 60 (typically coincident with the engine centerline 30) of the impeller 34. Tangential stress and radial stress are a function of the angular velocity of the impeller 34 and both vary as a function of radial distance from the rotational axis 60 of the impeller 34. A centrifugal compressor like that described herein is often subjected to a high temperature environment.

The aft surface 50 of the impeller 34 is often subjected to a high temperature environment. In addition, the hub 48 region adjacent the aft surface 50 (particularly the rear aligned with the rear cavity 56) is typically subjected to a tension-tension biaxial stress state (i.e., both radial and tangential stresses) with a high biaxiality ratio ("BR") during engine operation. The term "engine operation" as used herein refers to the normal range of impeller 34 angular velocities during operation. The term biaxiality ratio ("BR") as used herein refers to the radial stress divided by the tangential stress ($S_R/S_T$). A high BR and a high temperature environment can increase the potential for creep and low cycle fatigue (LCF) and thereby make the aft surface 50 of the impeller hub 48 (and the hub region adjacent thereto) a life-limiting factor for the impeller 34.

Creep strain evolution in Titanium or Nickel alloys are driven by the magnitudes of von Mises stress and temperature. In the tension-tension biaxial stress states, von Mises stress ("$S_{VM}$") may be expressed mathematically as:

$$S_{VM}=S_R\sqrt{(1-\mathrm{BR})^2+1+\mathrm{BR}^2} \quad \text{(Eqn. 1)}$$

Hence, the magnitude of $S_{VM}$ can be determined using radial strain ($S_R$) and the biaxiality ratio (BR).

The present disclosure reflects the surprising discovery that von Mises stress ("$S_{VM}$") and von Mises creep strain ("$EPCR_{VM}$") that may occur during engine operation (i.e., the normal range of angular velocity during operation) can be substantially improved (and the LCF life as well) by modifying the impeller hub 48 around the peak creep strain location in a manner that reduces the level of radial stress ($S_R$) and the biaxiality ratio (BR).

Aspects of the present disclosure include analyzing the impeller hub 48 in the region of the aft surface 50 to determine stress values (both radial stress and tangential stress) as a function of radial and axial directions. The present disclosure is not limited to any particular method of determining the stress values. The determined stress values (radial and tangential) can in turn be used to determine biaxiality (BR) values, and the determined radial stress values and the BR values, in turn can be used to determine $S_{VM}$ values. The stress data may also be used to determine a radial location of peak creep strain (designated "MX"). Aspects of the present disclosure also include modifying the geometry of the impeller aft surface 50 to produce an impeller 34 geometry that is subject to reduced radial stress ($S_R$) at and in close proximity to the radial location of peak creep strain, and that has a reduced biaxiality (BR) value at and in close proximity to the radial location of peak creep strain.

Figure 4:
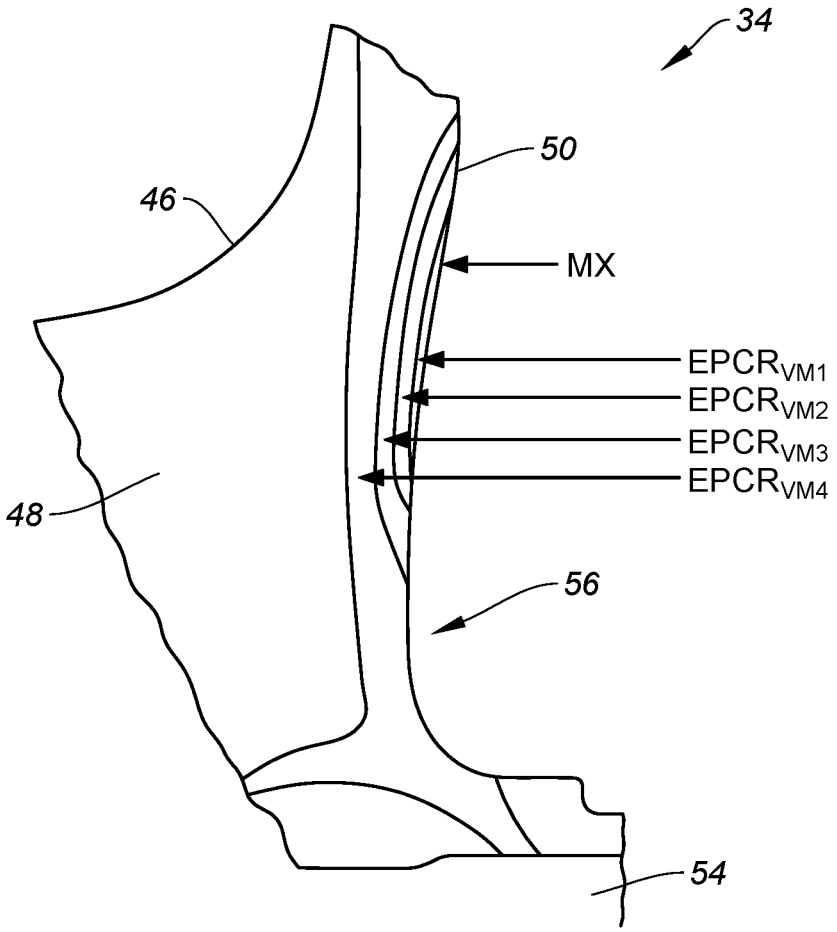
FIG. 4 is a diagrammatic enlarged partial view of the impeller rear cavity region of the impeller embodiment from the encircled region shown in FIG. 3 with a von Mises creep strain ($EPCR_{VM}$) contour.

FIG. 4 diagrammatically illustrates an unmodified impeller aft surface 50 region (e.g., see encircled region shown in FIG. 3) with a von Mises creep strain ($EPCR_{VM}$) contour map indicative of $EPCR_{VM}$ magnitude data analytically produced as described above. The $EPCR_{VM}$ contour map is diagrammatically shown as having four (4) strain regions of different magnitude in a radial/axial plane. The impeller 34 has a uniform geometric configuration around the circumference of the impeller 34, so the plane diagrammatically shown is not a function of circumferential position. von Mises creep strain region "$EPCR_{VM1}$", which is contiguous with the aft surface 50, possesses the highest level of average $EPCR_{VM}$. Strain region "$EPCR_{VM4}$", which is furthest from the aft surface 50, possesses the lowest average level of $EPCR_{VM}$. The average level of $EPCR_{VM}$ decreases from region $EPCR_{VM1}$ to region $EPCR_{VM4}$; i.e., $EPCR_{VM1}>EPCR_{VM2}>EPCR_{VM3}>EPCR_{VM4}$.

Figure 5:
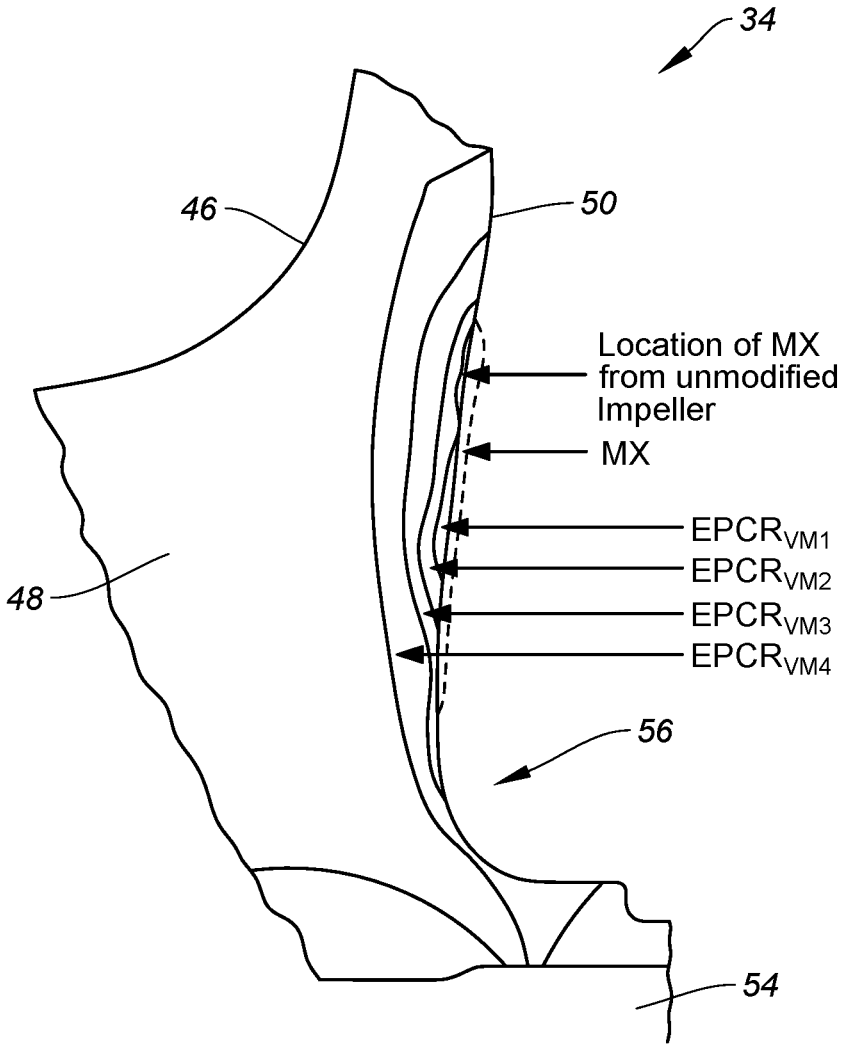
FIG. 5 is a diagrammatic enlarged partial view of the impeller rear cavity region of the impeller embodiment from the encircled region shown in FIG. 3 with a von Mises creep strain ($EPCR_{VM}$) contour, illustrating a modified impeller.

FIG. 5 diagrammatically illustrates a modified impeller aft surface 50 region with an $EPCR_{VM}$ contour map indicative of $EPCR_{VM}$ magnitude data analytically produced as described above. The modification of the impeller aft surface 50 includes altering the original geometric contour of a portion of the aft surface 50 that includes the determined the radial location of peak creep strain ("MX"). In this example, the modification to the impeller aft surface 50 is in the form of an additional amount of the material forming the impeller aft surface 50; i.e., increasing the thickness of the impeller hub 48. The modification is shown as a dashed line indicating the modified surface location. The radial length of the modification and the thickness (i.e., axial dimension) of the modification may be chosen based on the application at hand, provided the modification results in reduced radial stress ($S_R$) at and in close proximity to the radial location of peak creep strain, and a reduced biaxiality (BR) value at and in close proximity to the radial location of peak creep strain. The radial ends of the modification may be smoothly transitioned to the original geometry of the aft surface 50 to minimize local stress concentrations. FIG. 5 illustrates an $EPCR_{VM}$ contour map having four (4) $EPCR_{VM}$ regions of different magnitude in a radial/axial plane; i.e., like that shown in FIG. 4 with regions $EPCR_{VM1}$-$EPCR_{VM4}$, where $EPCR_{VM1}>EPCR_{VM2}>EPCR_{VM3}>EPCR_{VM4}$.

Figure 6:
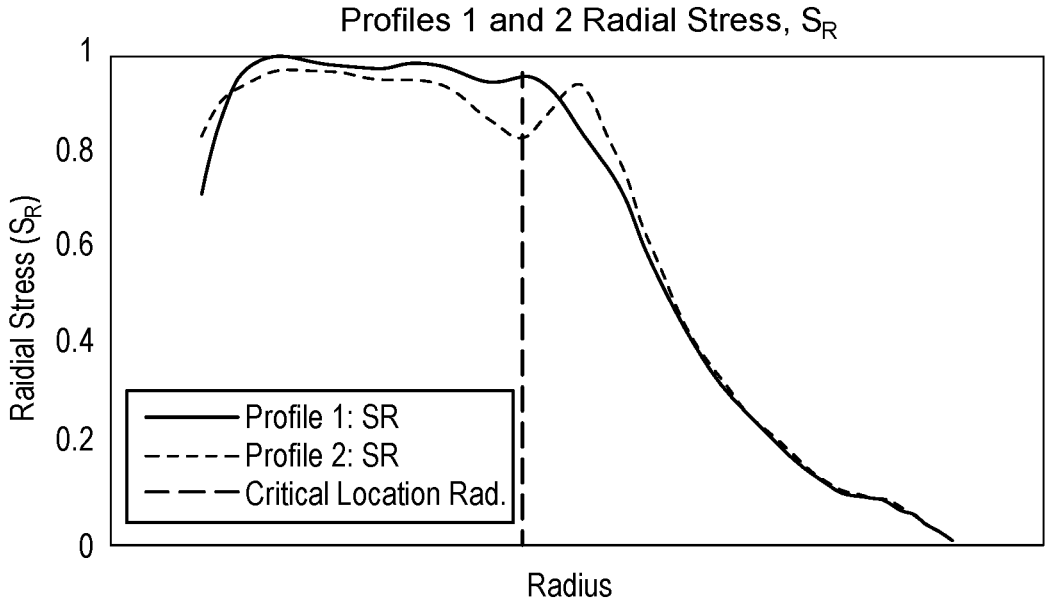
FIG. 6 is a graph of radial stress ($S_R$) as a function of impeller radius illustrating a first profile representative of the stress associated with an unmodified impeller and a second profile representative of the $S_R$ associated with a modified impeller.

The graph shown in FIG. 6 illustrates the radial stress as a function of radius. The stress values are scaled with respect to the peak radial stress of an unmodified impeller 34 with a normalized peak stress equal to one. Two data profiles are shown in FIG. 6 (Profile 1 and Profile 2) and a vertical line representative of the radial location of peak creep strain (MX). Profile 1 is representative of stress as a function of radius for an impeller 34 having an aft surface 50 contour that is not configured to reduce radial stress ($S_R$) at and in close proximity to the radial location of peak creep location, and is not configured to have a reduced biaxiality (BR) value at and in close proximity to the radial location of peak creep strain. Profile 2 is representative of an impeller 48 having an aft surface 50 contour that is configured to reduce radial stress ($S_R$) at and in close proximity to the radial location of peak creep strain, and is configured to have a reduced biaxiality (BR) value at and in close proximity to the radial location of peak creep strain. As can be seen in the graph, the level of stress at the radial location of peak creep strain is substantially lowered when the aft surface 50 contour is configured to reduce radial stress ($S_R$) and to have a reduced biaxiality (BR) value at the radial location of peak creep strain.

Figure 7:
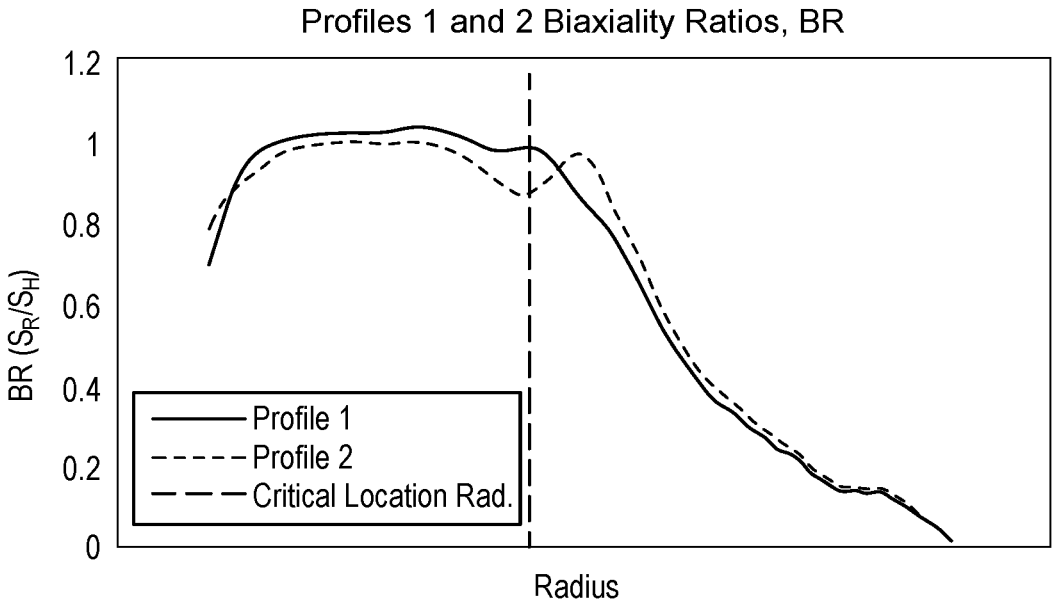
FIG. 7 is a graph of biaxiality ratio (BR) as a function of impeller radius illustrating a first profile representative of the BR data associated with an unmodified impeller and a second profile representative of the BR data associated with a modified impeller.

The graph shown in FIG. 7 illustrates BR as a function of radius. Here again, Profile 1, Profile 2, and a vertical line representative of the radial location of peak creep strain are shown. Profile 1 is representative of BR as a function of radius for an impeller 34 having an aft surface 50 contour that is not configured to reduce radial stress ($S_R$) nor is configured to have a reduced biaxiality (BR) value at the radial location of peak creep strain. Profile 2 is representative of BR as a function of radius an impeller 34 having an aft surface 50 contour that is configured to reduce radial stress ($S_R$) at the radial location of peak creep strain, and is configured to have a reduced biaxiality (BR) value at the radial location of peak creep strain. As can be seen in the graph, the BR level at the peak creep strain location is substantially lowered.

Figure 8:
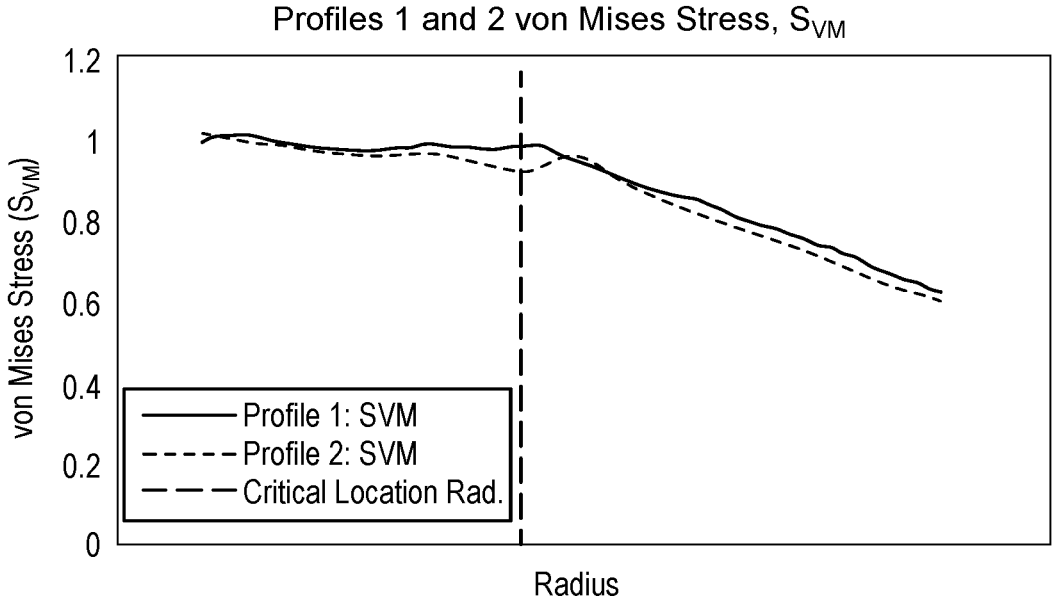
FIG. 8 is a graph of von Mises stress ($S_{VM}$) as a function of impeller radius illustrating a first profile representative of the $S_{VM}$ associated with an unmodified impeller and a second profile representative of the $S_{VM}$ stress associated with a modified impeller.

The graph shown in FIG. 8 illustrates $S_{VM}$ as a function of radius. Here again, Profile 1, Profile 2, and a vertical line representative of the radial location of peak creep strain are shown. Profile 1 is representative of $S_{VM}$ as a function of radius for an impeller 34 having an aft surface 50 contour that is not configured to reduce radial stress ($S_R$) nor is configured to have a reduced biaxiality (BR) value at the radial location of peak creep strain. Profile 2 is representative of $S_{VM}$ as a function of radius for an impeller 34 having an aft surface 50 contour that is configured to reduce radial stress ($S_R$) at the radial location of peak creep strain, and is configured to have a reduced biaxiality (BR) value at the radial location of peak creep strain. As can be seen in the graph, the $S_{VM}$ level at the radial location of peak creep strain is substantially lowered.

A centrifugal compressor impeller according to the present disclosure is understood to provide considerable benefit. The surprising discovery that an impeller aft surface 50 contour that is configured to reduce radial stress (SR) and a reduced biaxiality (BR) value in close proximity to the radial location of peak creep strain is understood to reduce the von Mises stress ("$S_{VM}$") and von Mises creep strain ("$EPCR_{VM}$") on the aft surface by as much as ten percent in some instances. In such instances, the useful life of the impeller may be increased appreciably.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc. The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

The invention claimed is:

1. A method of producing a centrifugal compressor impeller, the impeller including a hub with a rotational axis, a forward surface, and an aft surface, the aft surface extending between an outer radial surface of the impeller and a bore centered on the rotational axis, the method comprising:

analyzing the impeller to determine a stress field having tangential stress data values and radial stress data values as a function of radial position within the impeller hub and as a function of axial position within the impeller hub;

determining biaxiality ratio (BR) data using the determined tangential stress data values and the determined radial stress data values;

determining a peak von Mises creep strain location on the impeller;

contouring the aft surface at the peak von Mises creep strain location using the radial stress data values and the BR data, the contouring including providing a hub thickness aligned with the peak von Mises creep strain location so that the impeller hub has a localized area of decreased radial stress data values at the peak von Mises creep strain location; and producing the impeller with the aft surface.

2. The method of claim 1, wherein a portion of the aft surface has a concave arcuate contour that defines a rear cavity.

3. The method of claim 2, wherein the step of contouring the aft surface step includes contouring at least a portion of the rear cavity.

4. The method of claim 1, wherein the step of contouring the aft surface includes providing the hub thickness aligned with the peak von Mises creep strain location so that the impeller hub has a localized area of decreased BR data values at the peak von Mises creep strain location.

5. The method of claim 4, wherein the step of contouring the aft surface includes providing the hub thickness aligned with the peak von Mises creep strain location so that the impeller hub has a localized area of decreased von Mises stress ($S_{VM}$) values at the peak von Mises creep strain location.

6. The method of claim 1, wherein the step of contouring the aft surface includes providing a hub thickness that has a first region of radial stress data values, a second region of radial stress data values, and a third region of radial stress data values, wherein the first region of radial stress data values is disposed at a first radius from the rotational axis, the second region of radial stress data values is disposed at a second radius from the rotational axis, and the third region of radial stress data values is disposed at a third radius from the rotational axis, wherein the second radius is greater than the first radius, and the third radius is greater than the second radius, and wherein the radial stress data values in the second region are lower than the radial stress data values in both the first region and the third region, and wherein the determined von Mises peak creep strain is disposed at the second radius.

7. A method of producing a centrifugal compressor impeller, the impeller including a hub with a rotational axis, a forward surface, and an aft surface, the aft surface extending between an outer radial surface of the impeller and a bore centered on the rotational axis, the method comprising:

analyzing the impeller to determine a stress field having tangential stress data values and radial stress data values as a function of radial position within the impeller hub and as a function of axial position within the impeller hub;

determining biaxiality ratio (BR) data using the determined tangential stress data values and the determined radial stress data values;

determining a peak von Mises creep strain location on the impeller;

contouring the aft surface at the peak von Mises creep strain location using the radial stress data values and the BR data, wherein the contouring includes providing a hub thickness aligned with the peak von Mises creep strain location so that the impeller hub has a localized area of decreased BR data values at the peak von Mises creep strain location; and producing the impeller with the aft surface.

8. A method of producing a centrifugal compressor impeller, the impeller including a hub with a rotational axis, a forward surface, and an aft surface, the aft surface extending between an outer radial surface of the impeller and a bore centered on the rotational axis, the method comprising:

analyzing the impeller to determine a stress field having tangential stress data values and radial stress data values as a function of radial position within the impeller hub and as a function of axial position within the impeller hub;

determining biaxiality ratio (BR) data using the determined tangential stress data values and the determined radial stress data values;

determining a peak von Mises creep strain location on the impeller;

contouring the aft surface at the peak von Mises creep strain location using the radial stress data values and the BR data, wherein the contouring includes providing a hub thickness aligned with the peak von Mises creep strain location so that the impeller hub has a localized area of decreased von Mises stress ($S_{VM}$) values at the peak von Mises creep strain location; and producing the impeller with the aft surface.

* * * * *